US007146973B2

(12) United States Patent
Seekman et al.

(10) Patent No.: US 7,146,973 B2
(45) Date of Patent: Dec. 12, 2006

(54) LAUNCHING DEVICE

(75) Inventors: Bradley J. Seekman, Kalamazoo, MI (US); Christopher M. Monski, Kalamazoo, MI (US)

(73) Assignee: James Pneumatics, LLC, Kalamazoo, MI (US)

( * ) Notice: Subject to any disclaimer, the term of this patent is extended or adjusted under 35 U.S.C. 154(b) by 47 days.

(21) Appl. No.: 10/605,115

(22) Filed: Sep. 9, 2003

(65) Prior Publication Data

US 2005/0066951 A1 Mar. 31, 2005

(51) Int. Cl.
*F41B 11/00* (2006.01)

(52) U.S. Cl. ..... 124/71

(58) Field of Classification Search ..... 124/60, 124/63, 64, 69, 70–77, 56
See application file for complete search history.

(56) References Cited

U.S. PATENT DOCUMENTS

| | | | | |
|---|---|---|---|---|
| 2,816,484 | A * | 12/1957 | Grages | 89/194 |
| 3,989,027 | A | 11/1976 | Kahelin | |
| 4,019,480 | A | 4/1977 | Kenaio | |
| 4,038,961 | A | 8/1977 | Olofsson | |
| 4,079,901 | A | 3/1978 | Mayhew et al. | |
| 4,709,686 | A | 12/1987 | Taylor et al. | |
| 4,750,568 | A | 6/1988 | Roxton et al. | |
| 4,819,609 | A * | 4/1989 | Tippmann | 124/72 |
| 4,834,059 | A | 5/1989 | Moorhouse et al. | |
| 4,890,597 | A * | 1/1990 | Ekstrom | 124/74 |
| 4,936,282 | A * | 6/1990 | Dobbins et al. | 124/74 |
| 5,706,795 | A | 1/1998 | Gerwig | |
| RE36,965 | E * | 11/2000 | Salvemini | 441/85 |
| 6,244,261 | B1 * | 6/2001 | West, Jr. | 124/60 |
| 6,371,099 | B1 | 4/2002 | Lee | |
| 6,450,160 | B1 | 9/2002 | Fu et al. | |
| 6,540,160 | B1 * | 4/2003 | Rodriguez-Amaya et al. | 239/533.2 |
| 2002/0170551 | A1 * | 11/2002 | Kotsiopoulos et al. | 124/54 |
| 2003/0041849 | A1 * | 3/2003 | Perry et al. | 124/84 |

* cited by examiner

*Primary Examiner*—Troy Chambers
(74) *Attorney, Agent, or Firm*—John M. Naber; Dickinson Wright PLLC

(57) ABSTRACT

A launching device of the present invention includes a launch unit having a first coupling element and a second coupling element. A barrel may be releasably connected to one of the first and second coupling elements and a cylinder may be releasably connected to the other of the first and second coupling elements. The launch unit further includes a selector element to allow a user to pre-select an evacuation level of the contents of the cylinder. A specially designed valve assembly, bolt assembly and locking sear may also be incorporated that allow complete evacuation of the compressed gas through the launch unit and permit the projection of large objects such as grappling hooks. The launching device may also be converted to use as a fire extinguisher by quick connecting a cone shaped barrel and a cylinder of liquid carbon dioxide.

22 Claims, 22 Drawing Sheets

LAUNCHING DEVICE

BACKGROUND OF INVENTION

1. Field of the Invention

The present invention generally relates to a launching device and particularly to a launching device having interchangeable barrels and pressure bottles, capable of launching a variety of different objects.

2. Discussion of Related Art

Pneumatic guns and devices are known in the art and are used for a variety of different purposes. Some pneumatic devices are designed to propel various objects, but may be limited by either pressure or volume as to what objects can be propelled. These limitations may be due to the size and particular configuration of the device, or due to the type of object being propelled. For example, pressure in paint ball guns is limited to a safe velocity for that sport. These pressures and volumes are well below those that are needed to propel a large payload, such as a grappling hook. Further, modification of such a device to enable it to handle these larger payloads is typically not possible.

Pneumatic launching devices may also require a specially designed launching apparatus to which the object to be propelled is affixed prior to launching. This is the subject of the rescue apparatus disclosed in US Re. 36,965 to Salvemini. Salvemini utilizes a self-propelled pressurized missile configured to carry an object, such as a flotation device, when the missile is projected from the device. This type of device has limitations based on the particular configuration of the missile and the type of object the missile is designed to accommodate. In addition, the size of the pressurized missile may not allow the device to propel an item such as a grappling hook because the projectile may interfere with the hook's function and inhibit its ability to obtain a secure mount on a surface, beam, branch or the like. Further, this type of device would require a substantial amount of time to reload for reuse.

Some pneumatic guns and devices provide only the ability to pump or cock the gun to produce the required pressure to launch an object. This type of pumping can be very strenuous and time consuming to the user, and will not produce the pressure or volume of compressed gas required to project or propel a large or heavy object. Other pneumatic devices may provide a source of compressed gas to provide the necessary pressure to launch the object, but are frequently configured for launching only limited types of projectiles, such as tennis balls, baseballs, and the like. Reconfiguration of these devices for launching different sizes and types of balls often requires a substantial amount of time and effort. In addition, many of these types of devices do not provide the ability to vary the amount of compressed gas to be expelled upon actuation. They also typically expel gas into a chamber upon attachment of a gas source to the device.

Other methods of launching a projectile with compressed gas utilize various styles of pumps, which may be built into the unit, or may be spring driven. These designs are also not suitable to launch a substantial payload without a considerable amount of work to pump air into an internal chamber or an incredible amount of cocking effort by the user to load a spring. These styles also do not typically allow for quick and easy installment or removal of a pressure vessel, and typically feature a fixed barrel of a single caliber.

While there are a variety of types of pneumatic devices capable of launching an object, there are no known devices capable of receiving a variety of different sizes of launching barrels and cylinders with quick connecting and disconnecting mechanisms. This type of interchangeability would allow the device to be used for a variety of different purposes. There are also no known launching devices available in the art capable of launching a large object such as a grappling hook, due to the amount of pressure needed to propel such a large or heavy object.

Thus, there is a desire and need in the art to provide a launching device configured to quickly disconnect and connect a variety of different shapes and sizes of launching barrels and cylinders of compressed gas. There is also a desire and need to provide a launching device that enables a user to select evacuation levels to allow for launching either a small object, such as a tennis ball or a larger object, such as a grappling hook.

SUMMARY OF INVENTION

Accordingly, the present invention provides a launching device having interchangeable barrels of varying sizes and calibers, and capable of launching a variety of objects of various shapes, sizes and weight. The present invention is particularly suited for use as a rescue device and is capable of projecting or propelling a large object, such as a grappling hook, for climbing, rescue, body retrieval, and the like while providing for quick reconfiguration to accommodate different sizes of barrels and cylinders for using the launching device for alternative purposes, such as a fire extinguisher.

In one embodiment of the present invention, a launching device includes a launch unit having a first coupling element to which a barrel is releasably connected and a second coupling element to which a cylinder is releasably connected. The launch unit further includes a selector pin to allow a user to pre-select an evacuation level of the contents of the cylinder.

In another embodiment of the present invention, a launching device includes a launch unit, a trigger, a bolt assembly having a hollow bolt, and a locking sear. A barrel is connected to the launch unit and a valve assembly is connected to the launch unit and to a cylinder. The bolt assembly is movable between a first and second position and upon actuation of the trigger, the bolt assembly moves from the first position to the second position where it is in engagement with the valve assembly and the locking sear engages the bolt assembly holding the bolt assembly in the second position.

In yet another embodiment of the present invention, a method of using a launching device having a launch unit with a first and second coupling element and a trigger is provided, the method includes the steps of: selecting a barrel from a plurality of available barrels; releasably connecting the selected barrel to one of the first and second coupling elements; and releasably connecting a source of compressed gas to the other of the first and second coupling elements.

In still another embodiment of the present invention, a method of using a launching device as a fire extinguisher is provided, the launching device having a launch unit and the launch unit including a first coupling element, a second coupling element and a trigger, the method comprising the steps of: releasably quick connect coupling a cone shaped barrel having a diffuser to one of the first and second coupling elements; releasably quick connect coupling a cylinder to the other of the first and second coupling elements, the cylinder containing liquid carbon dioxide; expelling the contents of the cylinder from the launching device upon actuation of the trigger wherein the liquid carbon dioxide is converted to a dry ice substance as it passes through the diffuser.

Other features of the present invention will become more apparent to persons having ordinary skill in the art to which the present invention pertains from the following description and claims taken in conjunction with the accompanying figures.

BRIEF DESCRIPTION OF DRAWINGS

The foregoing features, as well as other features, will become apparent with reference to the description and figures below, in which like numerals represent like elements, and in which.

DETAILED DESCRIPTION

The present invention provides a launching device configured to receive barrels varying in size and caliber, and capable of launching a variety of objects having different weights, shapes and sizes. Examples of such objects may include grapple hooks for climbing and rescue, pellets, arrows, shot loads for survival activities, and "duck dummies" for training hunting dogs. The present invention also provides the ability to pre-select the volume of compressed gas expelled from the launching device upon activation, and allows for containment of the compressed gas in its holding reservoir until actuation of the launching device by a user. Another feature unique to the present invention is the ability to quickly disconnect and reconnect various barrels and tanks or cylinders to and from the unit. This quick and easy connection allows a user to quickly reconfigure launching device 20 to use for different purposes.

Figure 1:
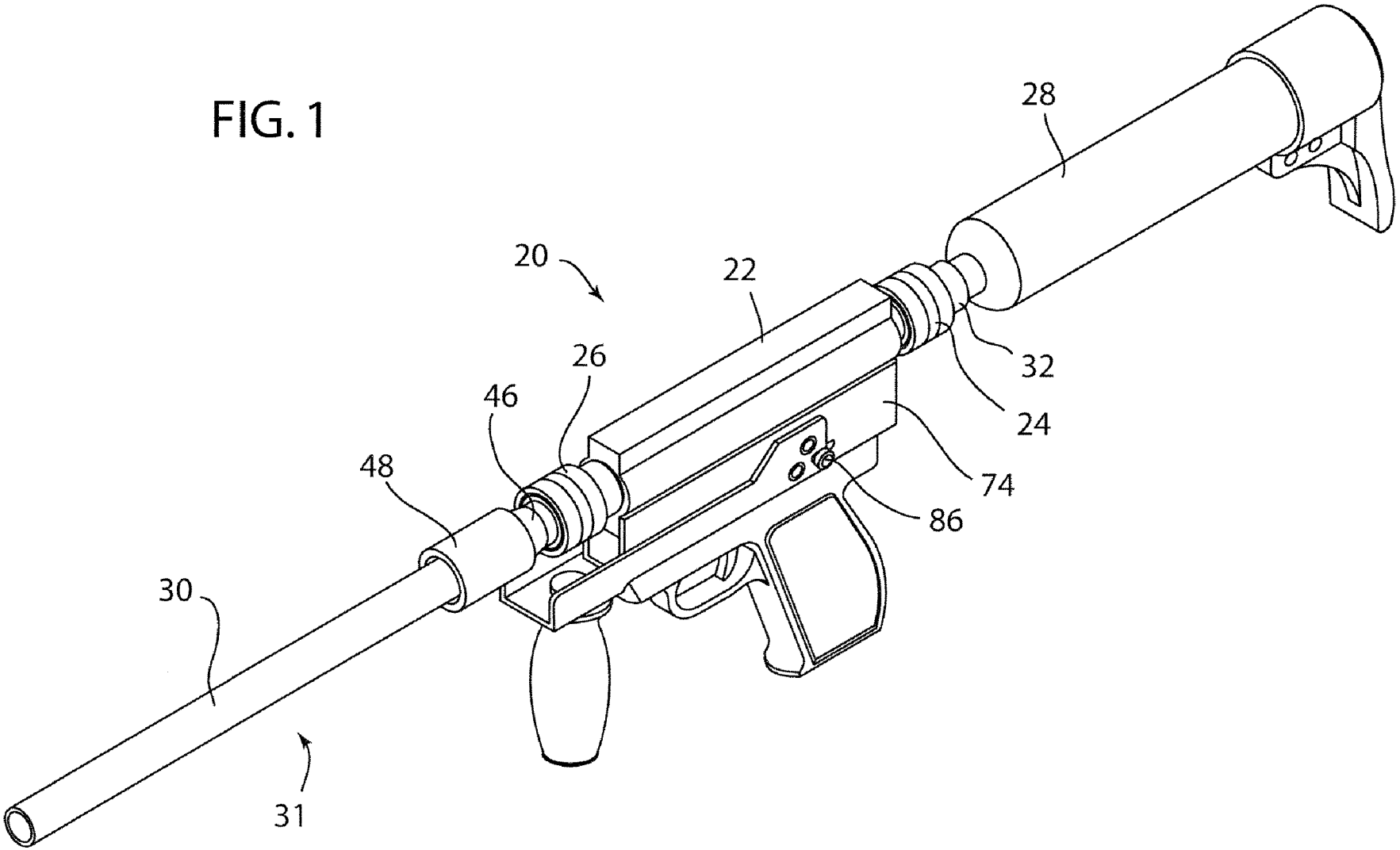
FIG. 1 is a perspective view of a launching device of the present invention.
Figure 2:
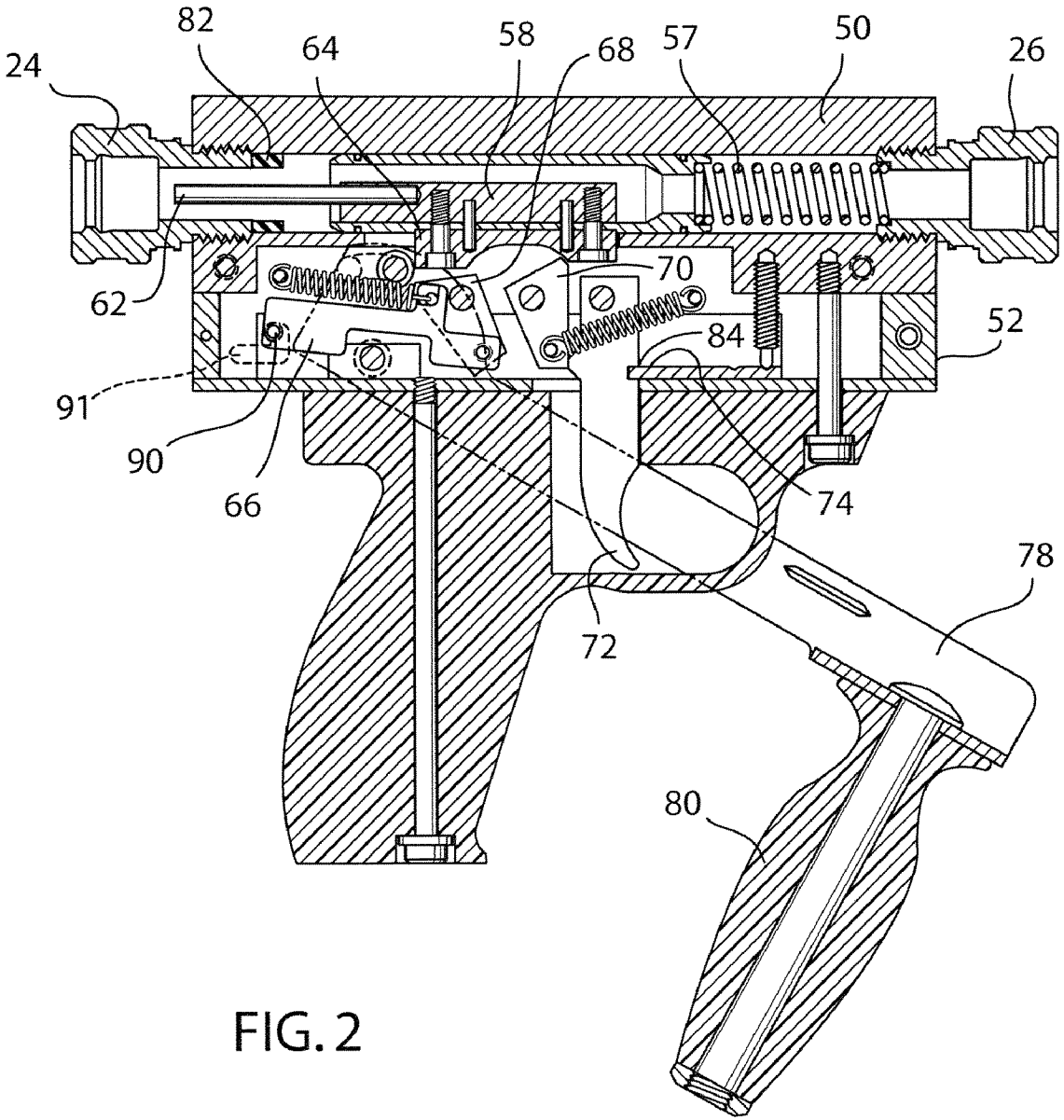
FIG. 2 is a cross sectional view of a launching device of the present invention illustrating the launching device in a "cocking" position.

Referring now to FIGS. 1 and 2, a launching device 20 of the present invention includes a launch unit 22, a first coupling element 24 and a second coupling element 26. First coupling element 24 and second coupling element 26 may include typical quick couple devices available in the art and may be threadably connected to launch unit 22 as shown in FIG. 2. First and second coupling elements 24 and 26 allow for quick engagement and disengagement of a selected barrel 30 and a selected cylinder 28 (such as a cylinder containing compressed air or nitrogen).

Cylinder Connection

Figure 3A:
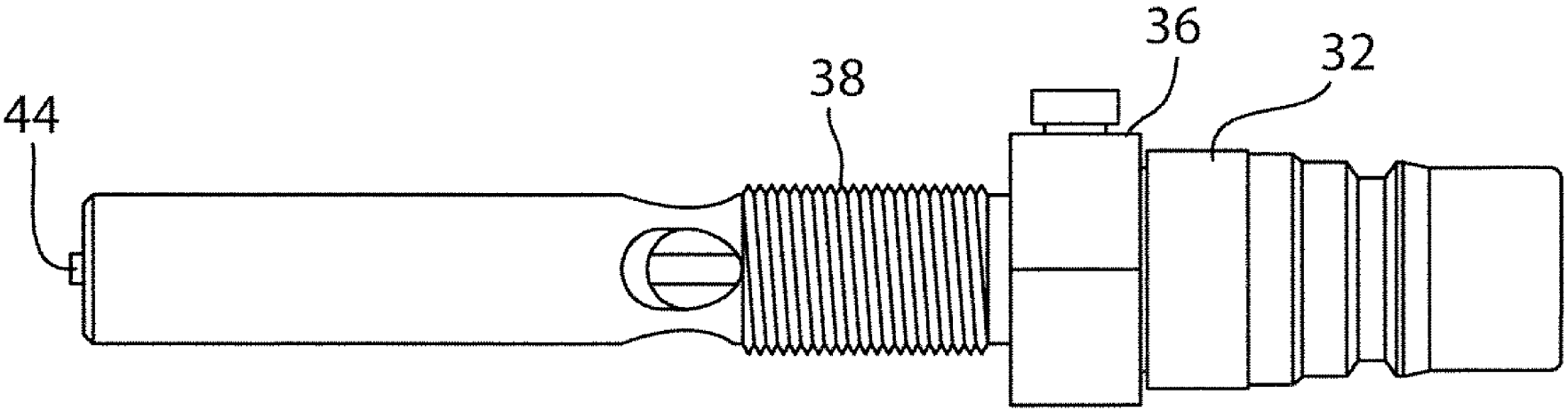
FIG. 3A is a side view of a valve assembly of the present invention.
Figure 3B:
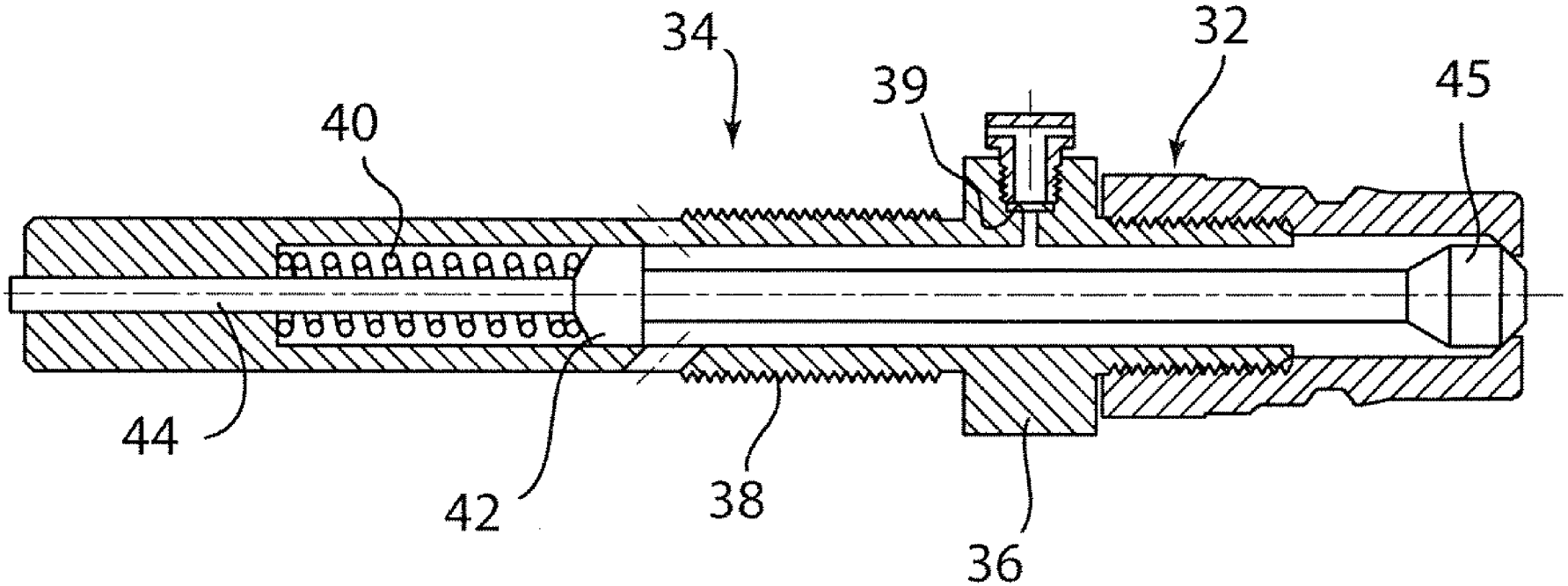
FIG. 3B is a cross sectional view of the valve assembly of the present invention shown in FIG. 3A.
Figure 6:
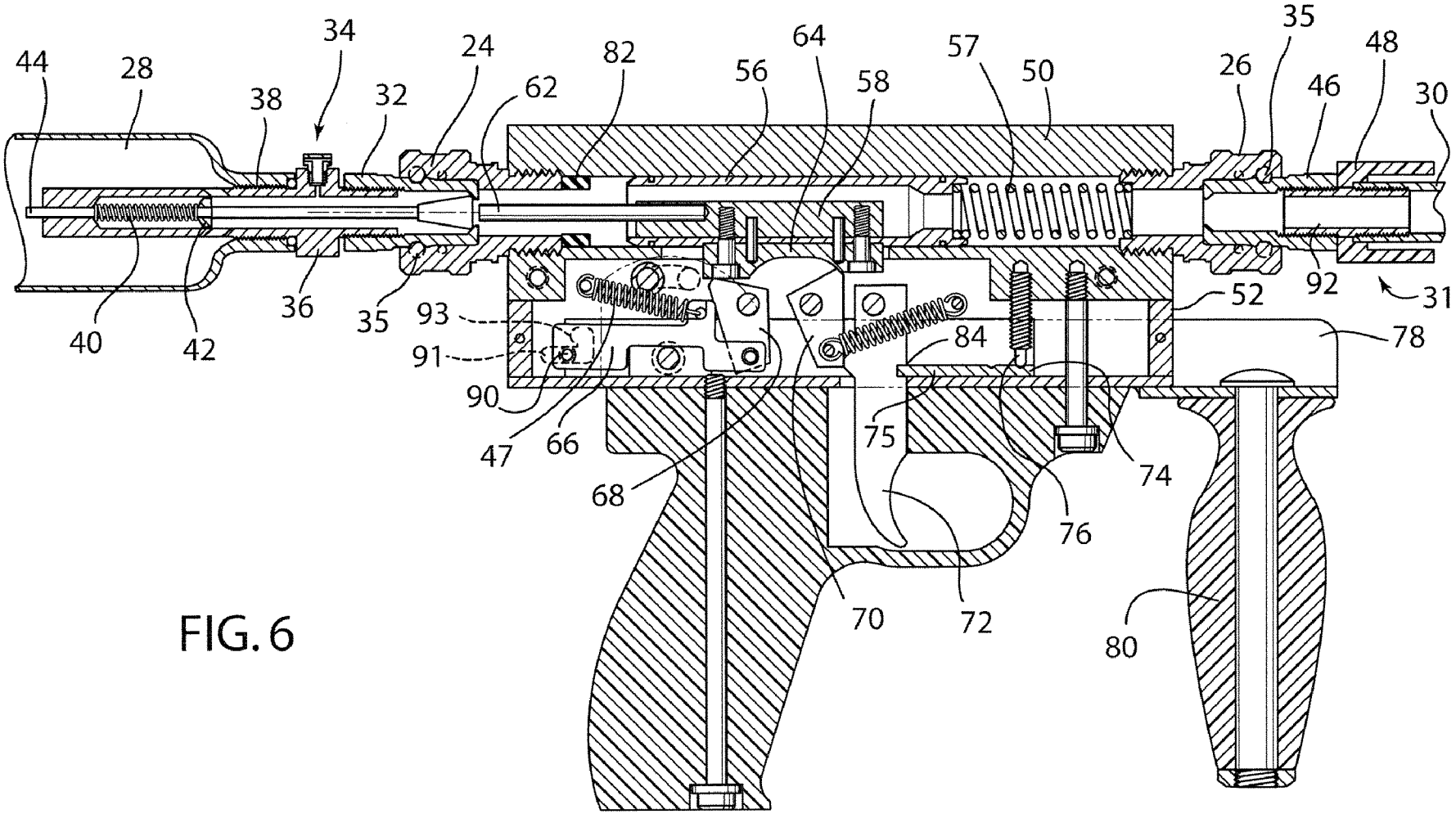
FIG. 6 is a cross sectional view of a launching device of the present invention in a full evacuation and ready to fire (cocked) position.

As most clearly shown in FIG. 6, first coupling element 24 may be threadably connected to launch unit 22 and configured to quick-connect to one end of a male coupling element 32. A seal 35 provides an air tight fit between first coupling element 24 and male coupling element 32. Male coupling element 32 may be configured to threadably connect to a specially designed valve assembly 34 on an opposite second end. Valve assembly 34 may include a valve body 36 and a threaded portion 38 (see FIGS. 3A and 3B). Threaded portion 38 is configured to threadably attach to the cylinder 28, such as a tank of compressed gas available in the art. A standard rupture disk 39 used on typical valve assemblies may also be used within the valve assembly 34 as shown in FIG. 3B. Rupture disks, as known in the art, are typically rated with a safety margin appropriate for the particular cylinder being used. When the pressure in the cylinder of compressed gas exceeds a specified level (a level the particular rupture disk is rated for), the disk ruptures and allows the pressure to escape through the fitting that holds it in the valve assembly. The present invention is capable of functioning at a variety of different pressure levels for various applications. It may use pressures as low as 351,535 kg/sq.M (500–650 psi), or as high as 3,515,350 kg/sq.M (5000 psi), which would require the cylinder 28 and rupture disk 39 to be rated accordingly. A preferred embodiment may utilize a cylinder of compressed gas rated at 1,265,400 kg/sq.M (1800 psi).

Figure 9:
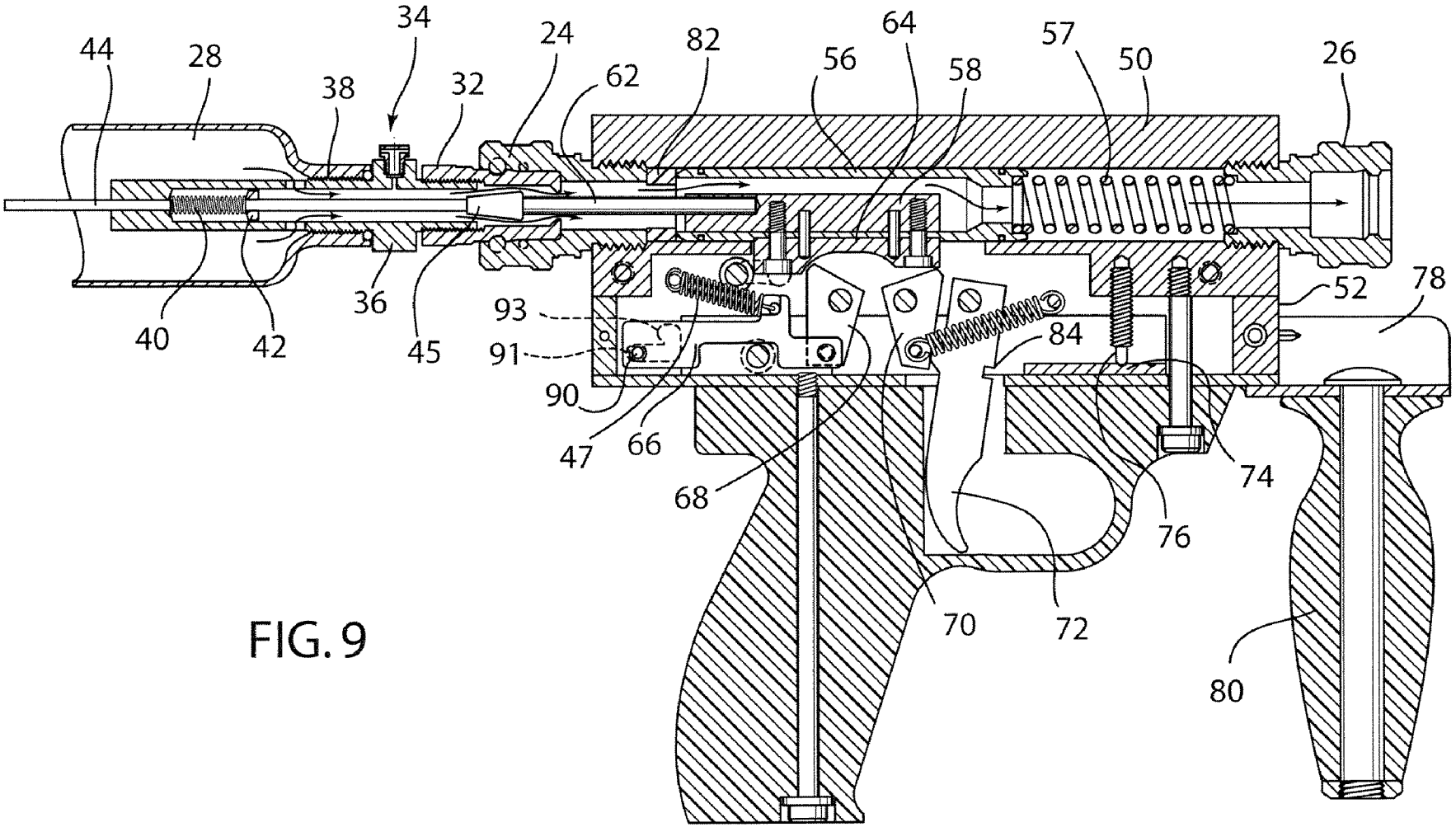
FIG. 9 is a side cross sectional view of a launch unit of the present invention in a full evacuation and fired position.

The valve assembly 34 may also include a valve spring 40, a spring collar 42 and a valve pin 44 as shown in FIG. 3B. Valve assembly 34 may be configured to handle a massive amount of turbulence from the volume of pressurized gas that may flow through it. Common designs of such valves currently available in the art typically expose the valve spring to this damaging flow, which may destroy the spring after about three actuations of the device. The present invention protects valve spring 40 by placing it behind the spring collar 42 on the valve pin 44 as shown in FIGS. 3B and 9. Valve assembly 34 may be configured with valve spring 40 having any of a variety of different force and weight configurations to provide different operating pressures for launching device 20.

Barrel Connection

Figure 4:
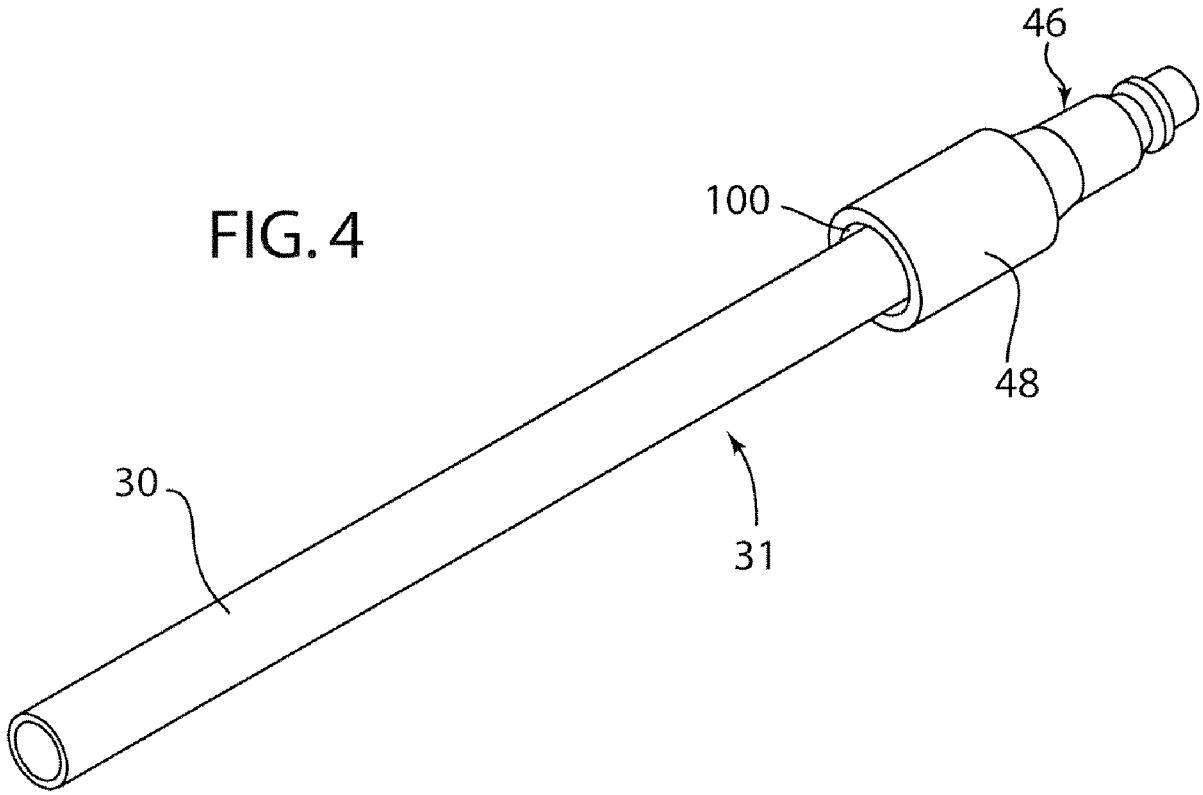
FIG. 4 is a perspective view of a barrel assembly of the present invention.
Figure 18:
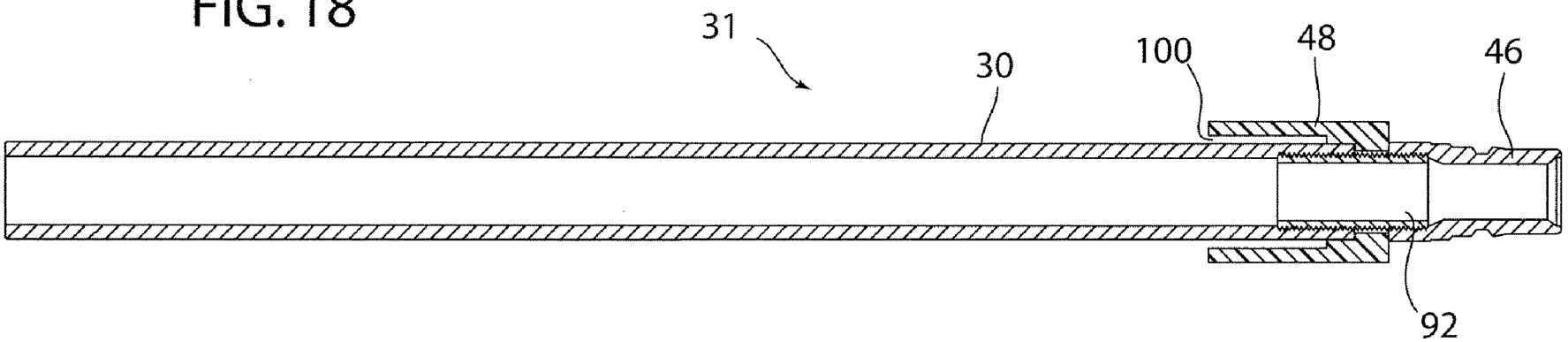
FIG. 18 is a cross sectional view of a barrel assembly of the present invention.

Second coupling element 26 may be threadably connected to launch unit 22 as shown in FIG. 2, and may be configured to quick connect to one end of a barrel assembly 31 as shown in FIG. 6. Barrel assembly 31 may include a barrel 30 and a barrel connector 46 as shown in FIGS. 1 and 4. Barrel connector 46 provides the quick connect and release mechanism for attachment of a selected barrel 30 to second coupling element 26. A seal 35 provides an air tight fit between second coupling element 26 and barrel connector 46. Barrel connector 46 may be threadably connected to barrel 30 with an internal threaded connector 92 as shown in FIGS. 6 and 18. Many different sizes and shapes of barrel 30 may be configured to connect to launch unit 22. This versatility of launching device 20 provides launching device 20 with the ability to propel a variety of different sizes, shapes and weights of objects outwardly from the launching device 20. The user may simply reconfigure launching device 20 with a desired barrel 30 to meet the particular need. For example, if launching device 20 is equipped with a barrel 30 having an outer diameter of approximately 1.905 cm (¾ inch) and a cylinder rated at 1,265,400 kg/sq.M (1800 psi), the launching device 20 will be capable of propelling an object from the device at 949,050 kg/sq.M (1350 lbs) of force. If the barrel 30 has an outer diameter of approximately 2.54 cm (1 inch), a full 1,265,400 kg/sq.M (1800 lbs) of force may be achieved.

Launch Unit

Figure 5:
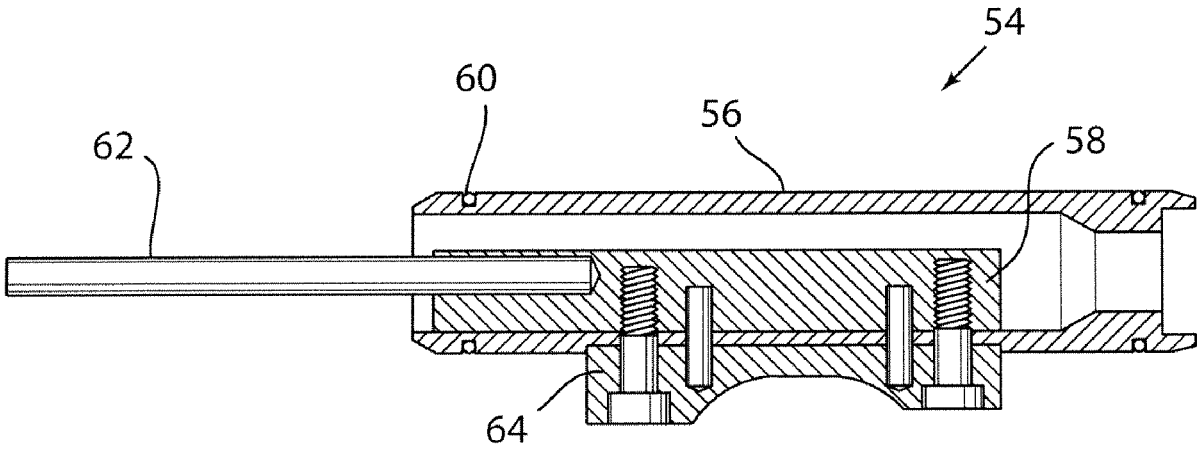
FIG. 5 is a cross sectional view of a bolt assembly of the present invention.
Figure 7:
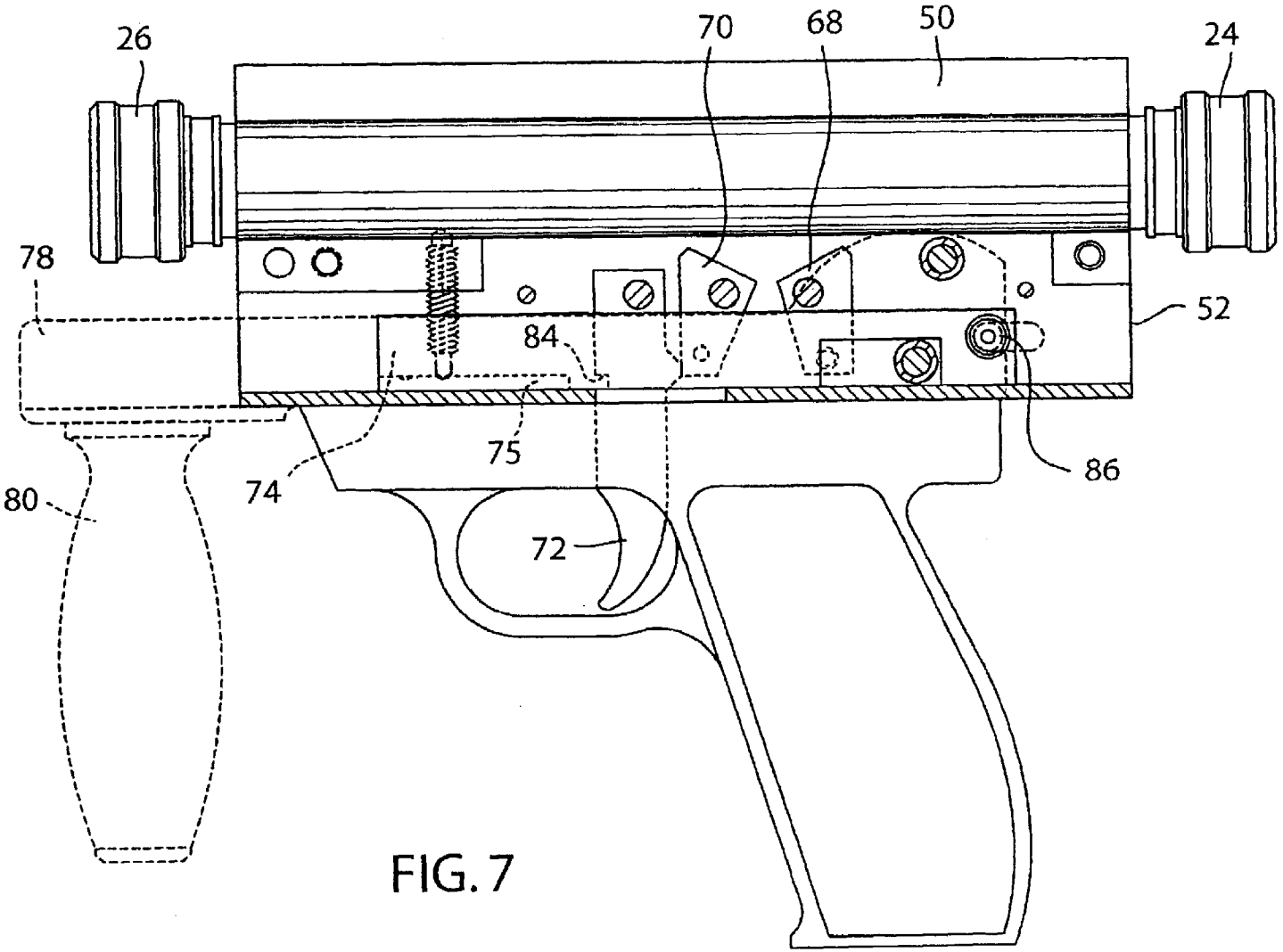
FIG. 7 is a side view of a launch unit of the present invention illustrating the safety in a disengaged position.
Figure 10:
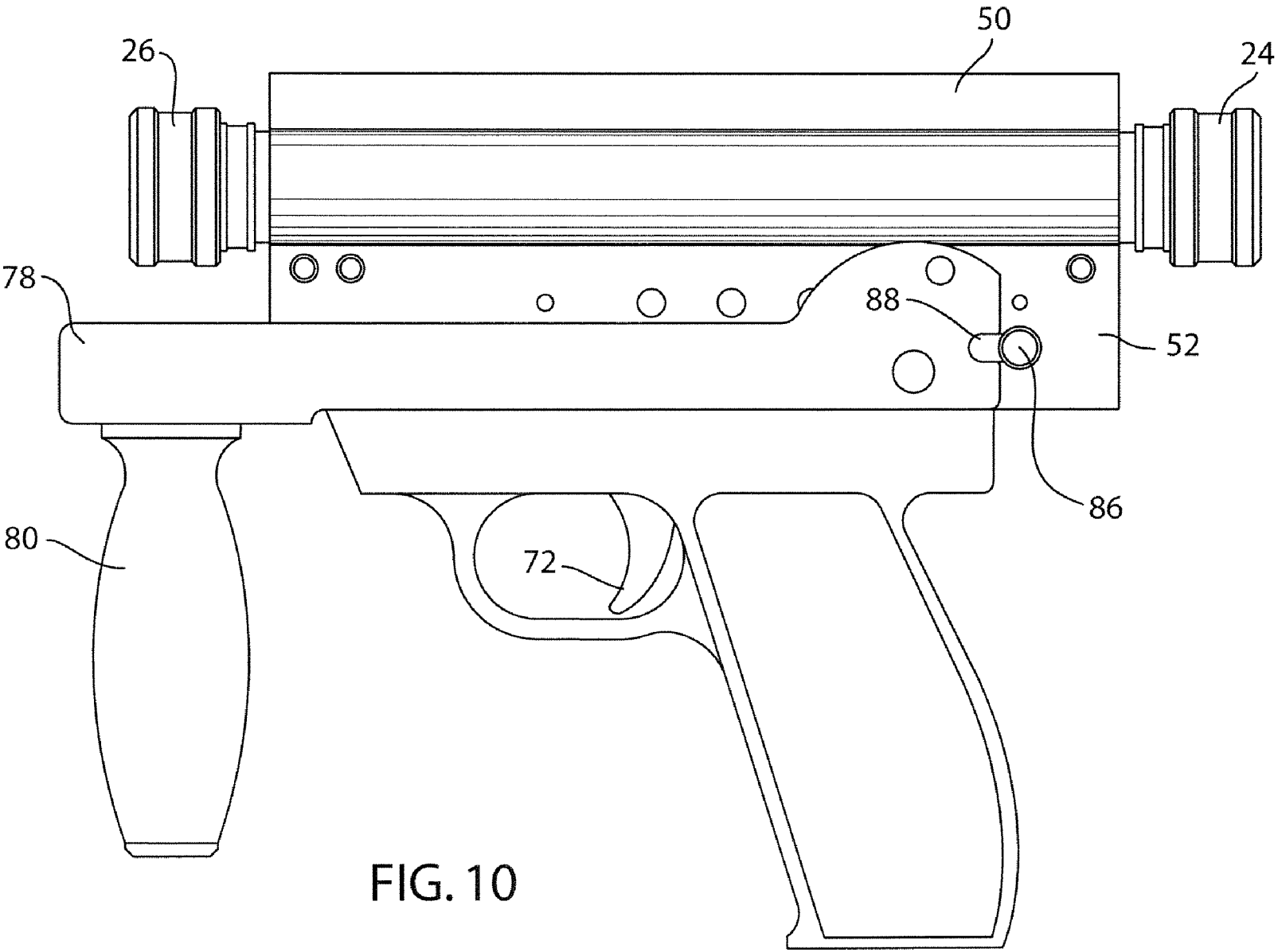
FIG. 10 is a side view of a launch unit of the present invention in a safety engaged position.

Launch unit 22 includes an upper receiver portion 50 and a lower receiver portion 52 as most clearly shown in FIGS. 7 and 10. Upper receiver portion 50 may include a specially designed bolt assembly 54 having a hollow bolt 56 configured to allow gas to flow through bolt 56 and straight through upper receiver 50 (see FIGS. 5 and 6). Upper receiver portion 50 may also include a bolt spring 57 configured to engage bolt assembly 54, and includes larger internal passageways than typical launching devices. These larger passageways facilitate movement of compressed gas or other substances through upper receiver portion 50. This flow of gas is illustrated by arrows in FIG. 9. As shown in FIG. 5, bolt assembly 54 may also include a firing pin block 58, O-ring seals 60, a firing pin 62 and a bolt lug 64.

Figure 11:
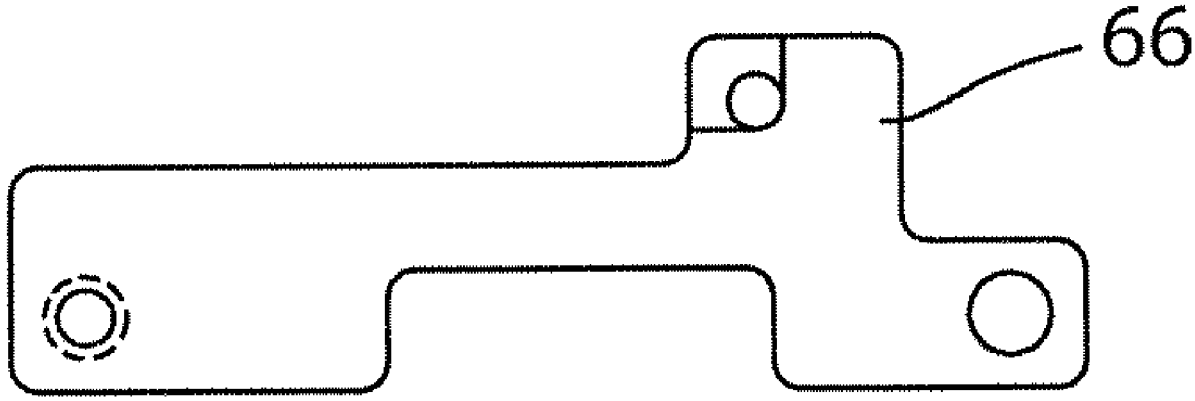
FIG. 11 is a side view of a sear linkage of the present invention.
Figure 12:
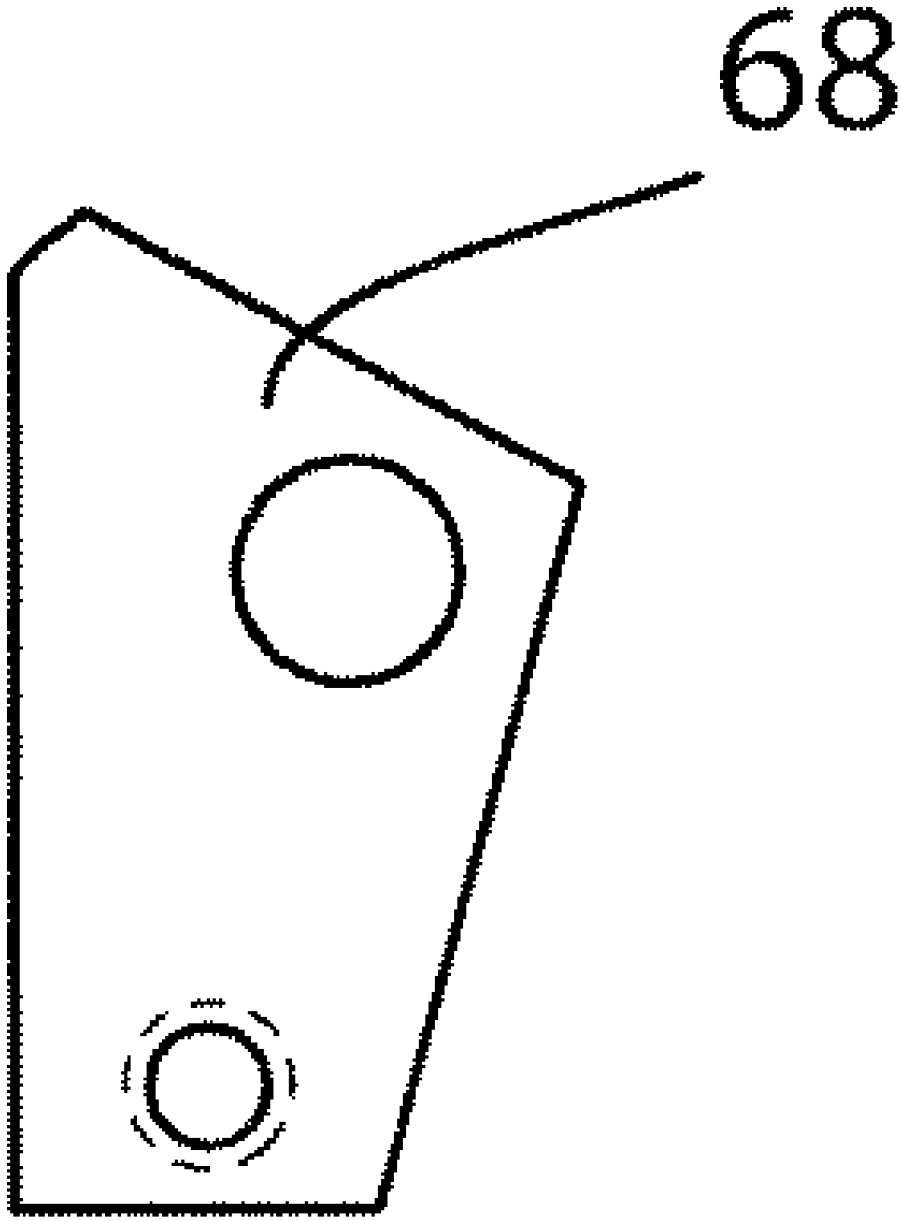
FIG. 12 is a side view of a locking sear of the present invention.
Figure 13:
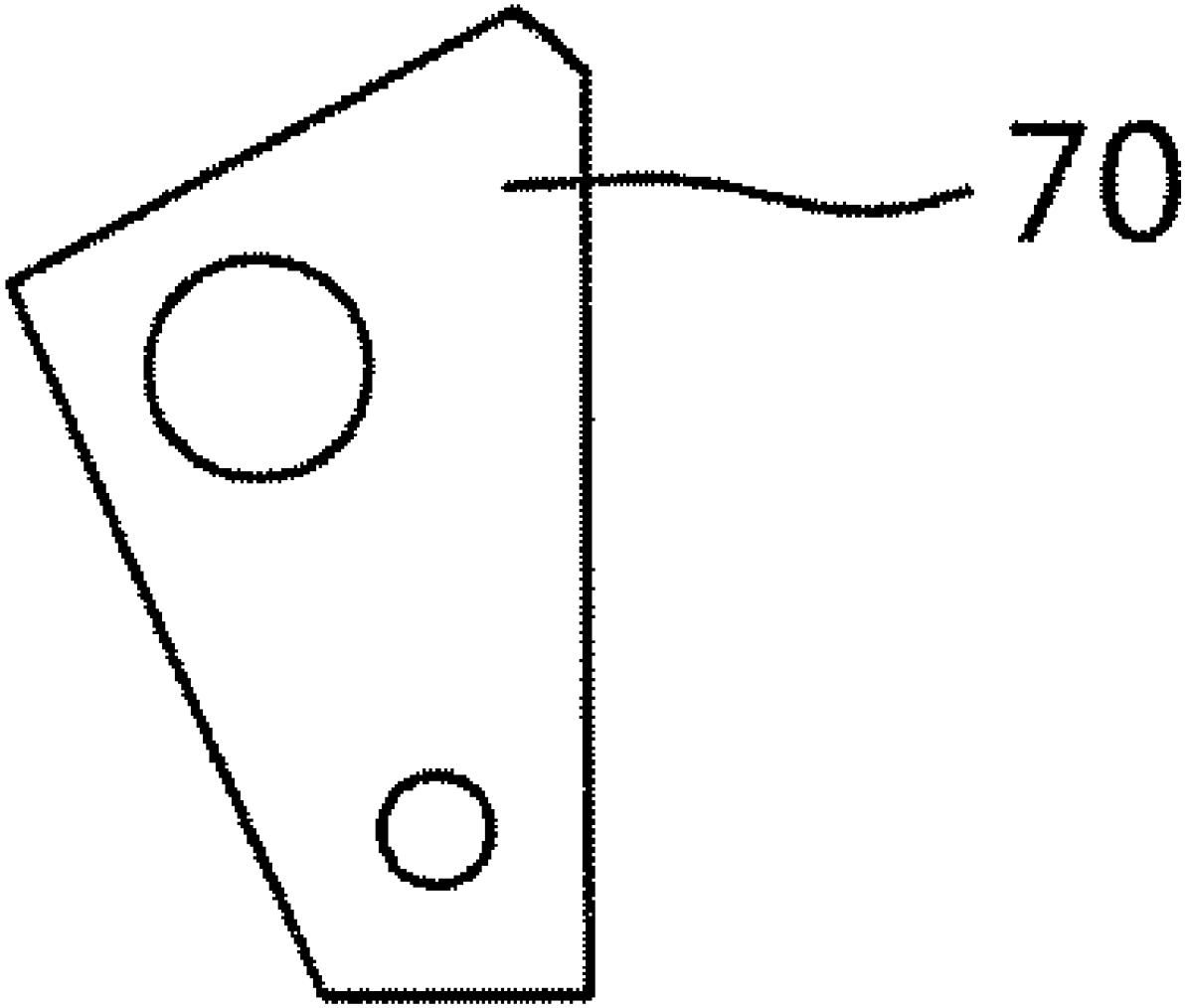
FIG. 13 is a side view of a trigger sear of the present invention.
Figure 14:
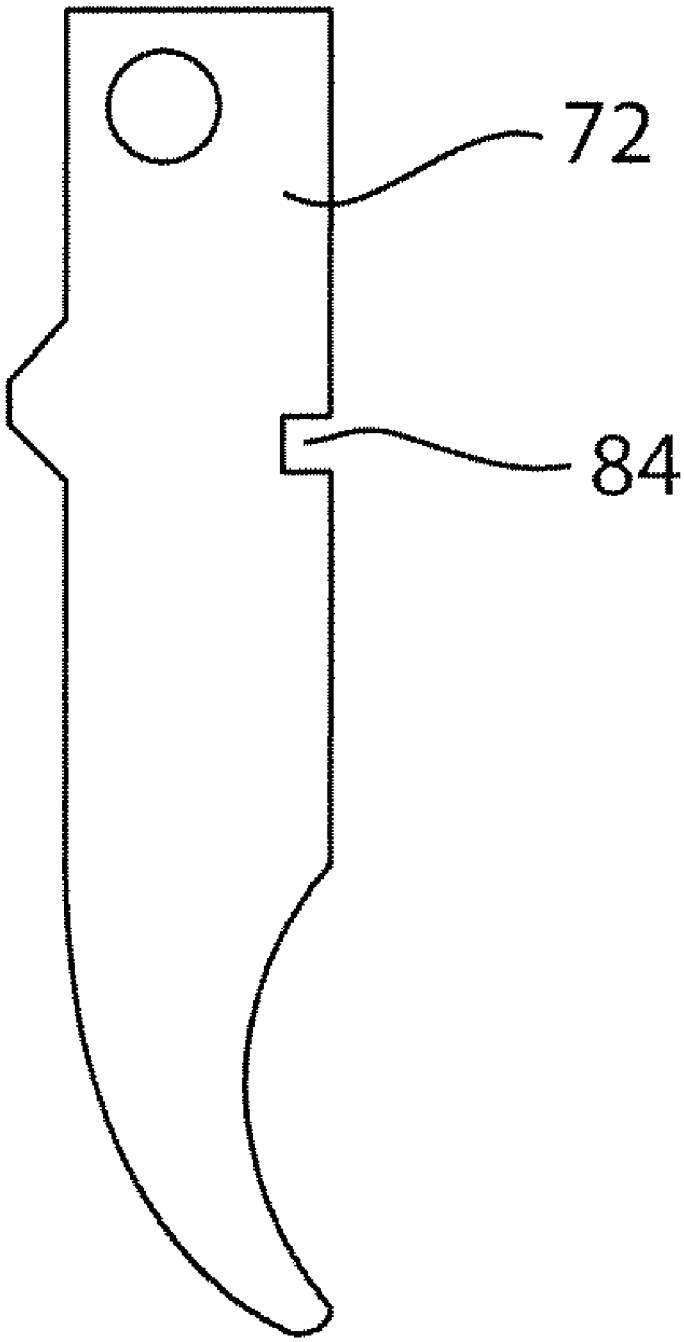
FIG. 14 is a side view of a trigger of the present invention.
Figure 15:
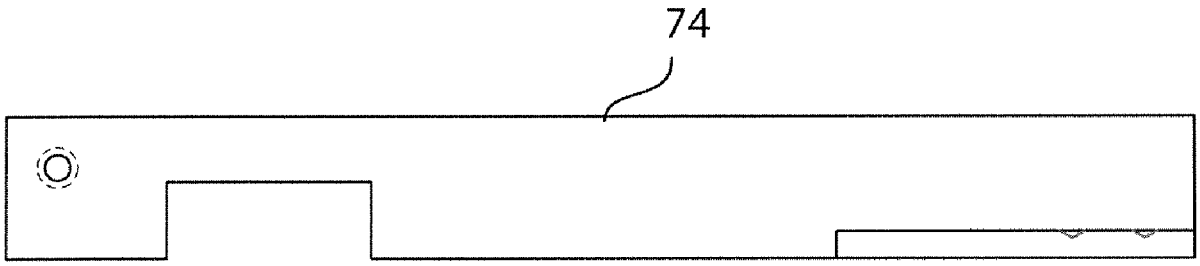
FIG. 15 is a side view of a safety of the present invention.

Referring to FIG. 2, lower receiver portion 52 may include a sear linkage 66 (see also FIG. 11), a locking sear 68 (see also FIG. 12), a trigger sear 70 (see also FIG. 13), a trigger 72 (see also FIG. 14), a safety 74 (see also FIG. 15), a safety detent 76 and a cocking lever 78.

Cocking lever 78 provides a mechanical advantage for easier cocking action and includes a grip 80 to provide a comfortable gripping surface for the user. Many available devices utilize a very light spring and simple pull-back bolt, which only permits the user to produce a small amount of pressure. Others may utilize a heavy spring and a cocking lever that requires a substantially larger angle of downward rotation, and this requires more effort by the user. In contrast to these devices, the present invention incorporates a heavy bolt spring 57 to drive the bolt assembly 54 only approximately 1.905 cm (¾ inches), and only requires an angle of rotation of approximately 30 degrees to cock the launching device 20. With this configuration, the spring is compressed about 113.4 kilograms (250 pounds), with only 13.6 kilograms (30 pounds) of cocking force, thus providing for an easier cocking effort by the user.

Cocking the Launching Device

Figure 8:
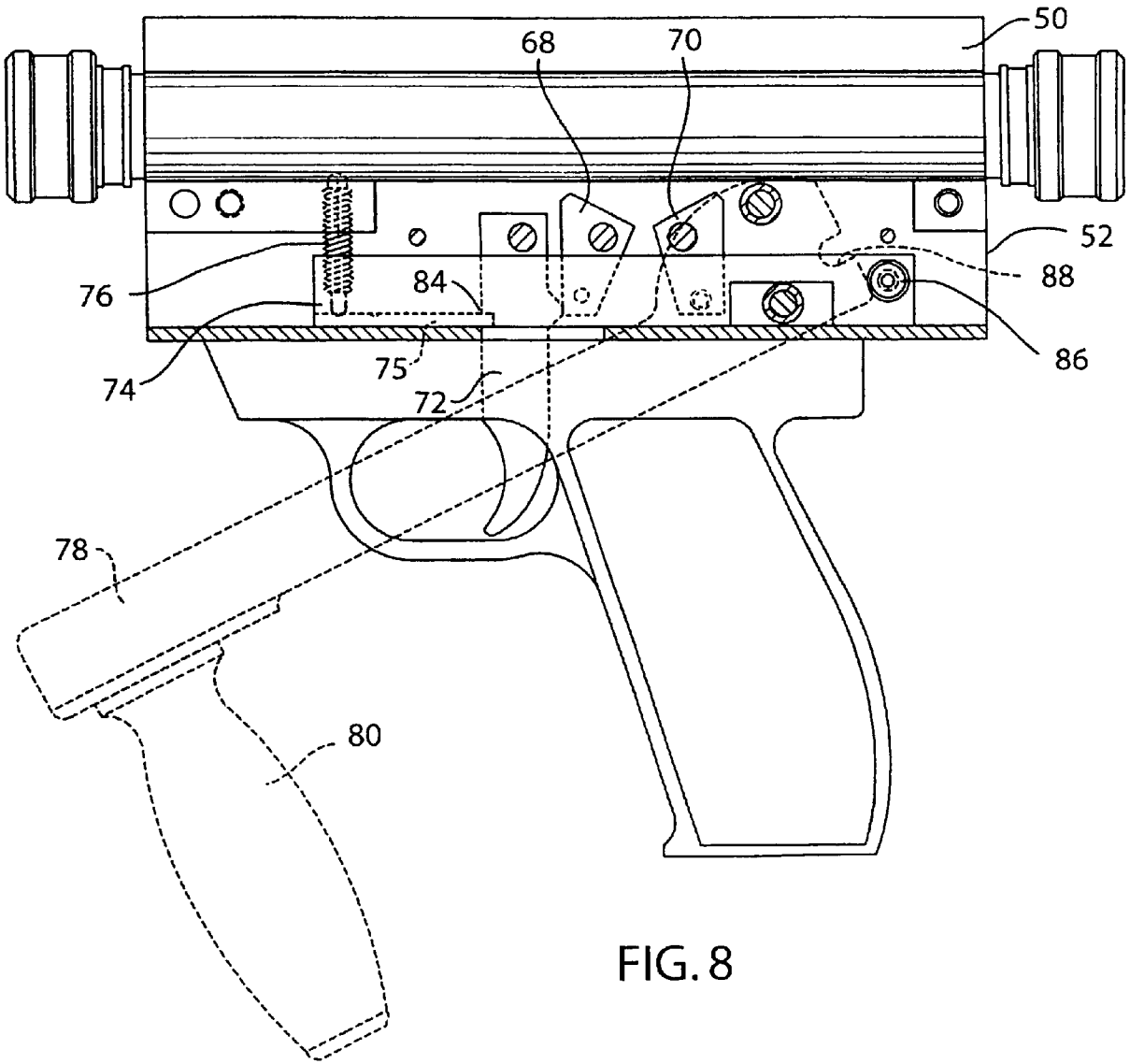
FIG. 8 is a side view of a launch unit of the present invention illustrating the cocking lever in a "cocking" position.

To cock launching device 20 (i.e., to place it in a ready to fire position), safety 74 must be engaged as shown in FIGS. 2 and 8. This will prevent launching device 20 from being fired. As shown, when safety 74 is engaged, an upturned flange 75 on safety 74 is slidably received in a safety notch 84 on trigger 72, and a notch 88 on cocking lever 78 disengages from a locking button 86 (see FIG. 10). Also required to cock launching device 20, a selector pin 90 must be moved to an up position within an L-shaped slot 91 as shown in FIG. 2. Selector pin 90 is accessible by a user on the outer surface of lower receiver 52. Selector pin 90 allows a user to select between releasing the full amount of gas or an amount of gas with the kinetic energy equal to the amount of energy stored in the drive spring 57. L-shaped slot 91 includes a holding notch 93 to hold pin 90 in this up position. With pin 90 in this position, it places sear linkage 66 in an up position and keeps locking sear 68 downward and away from bolt lug 64 as shown in FIG. 2. Bolt assembly 54 will be in a forward position away from the cylinder 28. If locking sear 68 were not held in this position, it would contact bolt lug 64 and prevent bolt assembly 54 from moving. If bolt assembly 54 is immobilized, cocking of the launching device 20 will not be permitted. With selector pin 90 in an up position and safety 74 engaged, launching device 20 may then be cocked by rotating cocking lever 78 downward. Launching device 20 will not be able to be fired until cocking lever 78 is placed back to its horizontal position and notch 88 is locked back on locking button 86.

Launching an Object in Partial Evacuation Mode

To use launching device 20 to propel small or light weight objects (such as tennis balls, paint balls, and the like), only a small amount of compressed gas may be required. For this type of projectile, launching device 20 may be placed in a "partial evacuation" mode by moving selector pin 90 to the up position as described above for cocking launching device 20 and as shown in FIG. 2. Safety 74 must be placed in a disengaged position (disengaged from safety notch 84) and locking button 86 positioned within notch 88 on cocking lever 78. In this position, the ability to cock launching device 20 will be disabled and trigger 72 will be able to be actuated.

When launching device 20 is fired in the partial evacuation mode, sear linkage 66 is in an up position and prevents locking sear 68 from contacting bolt lug 64. The valve pin 44 will be thrust quickly into the cylinder 28 containing compressed gas and pressure remaining in the cylinder 28, together with the biasing force of valve spring 40, urges the valve pin 44 back to a closed condition quickly after firing. Therefore, the cylinder 28 is only momentarily opened, releasing only a small amount of compressed gas. The amount of compressed gas released can be modified by changing the force of bolt spring 57 (i.e., providing a spring having a different force rating), the mass of bolt assembly 54, the pressure of the compressed gas within the source of compressed gas 28, or the force of valve spring 40 in valve assembly 34.

Launching an Object in Full Evacuation Mode

The user may alternatively select a "full evacuation" mode by moving selector pin 90 to a lowered position within L-shaped slot 91 as shown in FIG. 6. Placing selector pin 90 in this position, allows the entire contents of cylinder 28 to be expelled upon firing of launching device 20, and permits larger objects to be propelled from launching device 20. When trigger 72 is actuated, the bolt assembly 54 is released by the trigger sear 70 and slams rearward towards the valve assembly 34. The bolt assembly 54 moves against a bumper 82 and the firing pin 62 slams against a valve pin cap 45 as shown in FIG. 9. A linkage spring 47 is connected to the sear linkage 66 and pulls the sear linkage 66, which is connected to a bottom portion of the locking sear 68. This motion biases the locking sear 68 to rotate upwardly and into bolt lug 64. Locking sear 68 holds hollow bolt 56 in this rearward position to prevent valve assembly 34 from closing. This unique configuration, along with the hollow bolt 56 and large passageways through upper receiver 50, allows for the complete evacuation of the contents of cylinder 28 (compressed gas in this example) through the hollow bolt 56 and upper receiver portion 50 in a very short period of time (almost instantaneous). With the compressed gas being fully expelled in a rapid time frame, launching device 20 is able to release a very high level of pressure and gas volume, enabling it to project or propel large or heavy objects. Typical launching devices use a firing pin in the bolt that hits the poppet in the cylinder of compressed gas. This will release only a small amount of compressed gas (as with partial evacuation mode described above), and then the bolt or pin moves back to a seated position, closing the poppet and retaining the unused gas for a later use. Thus, these types of devices cannot be used to propel objects requiring large amounts of pressurized gas to be released upon firing. With the present invention, because of the ability to expel the full amount of compressed gas from the cylinder 28, launching device 20 is able to propel larger objects than other available devices.

Grappling Hook

Figure 16:
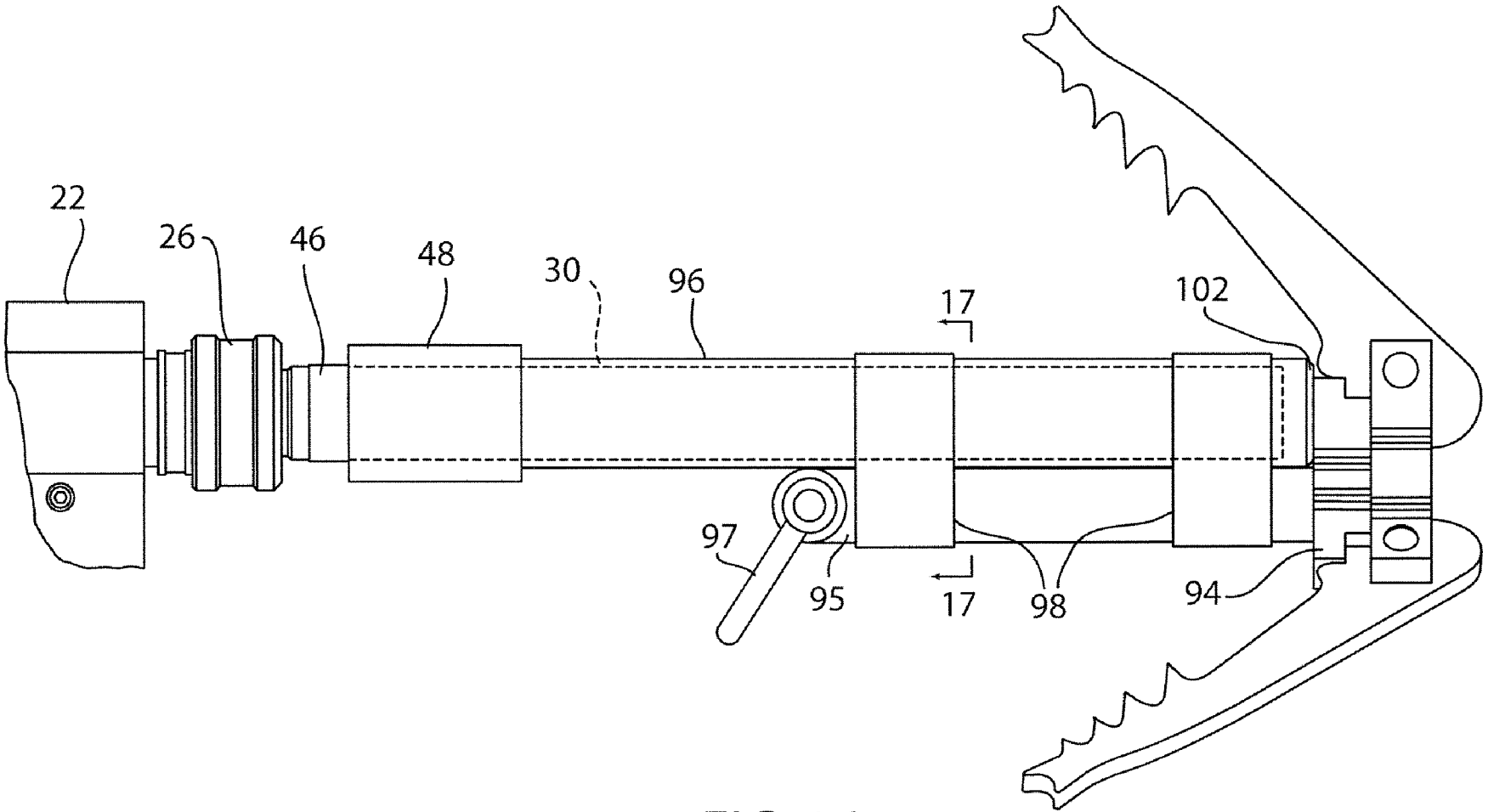
FIG. 16 is a side view of a launch tube and grappling hook of the present invention.
Figure 17:
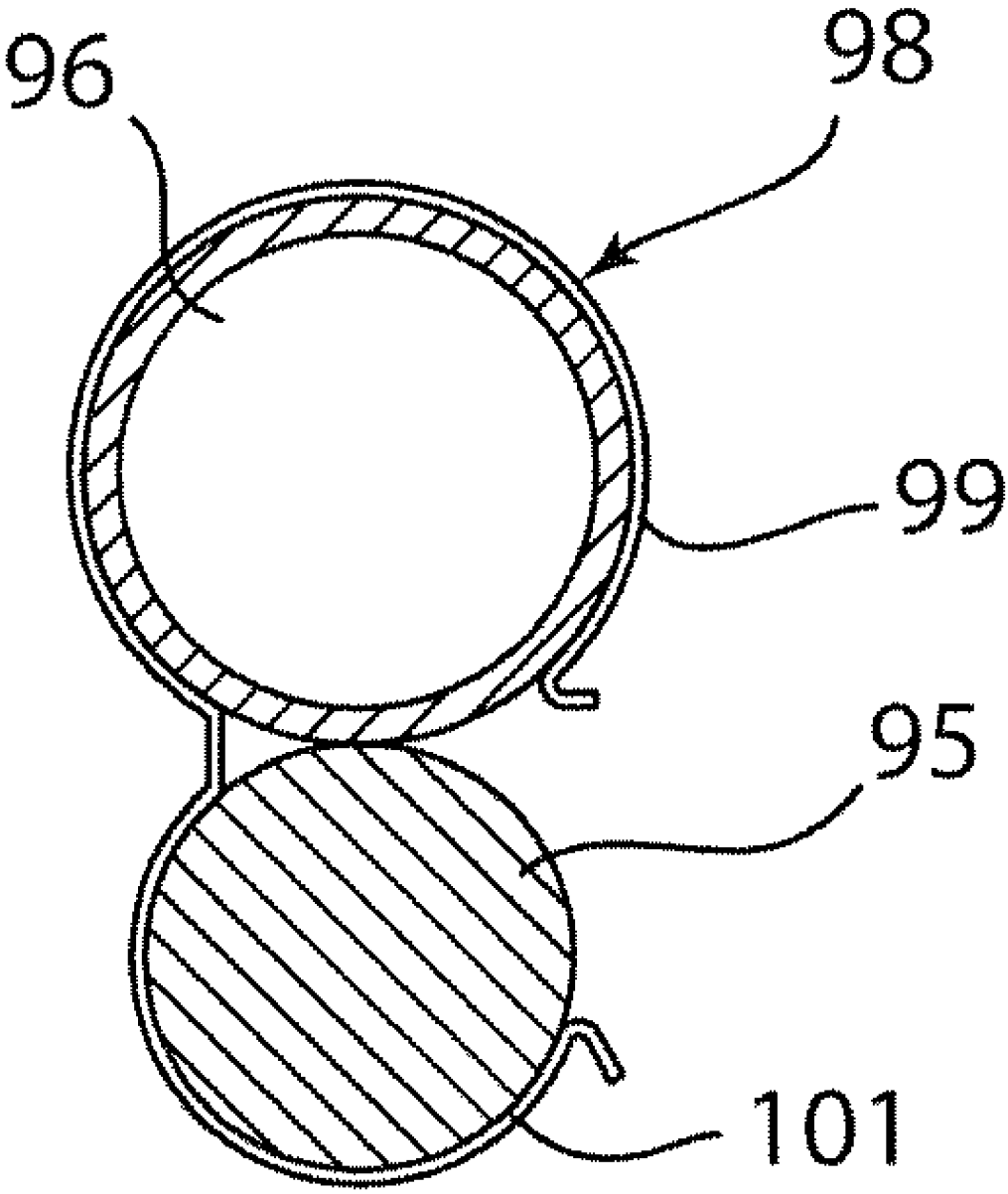
FIG. 17 is a sectional view taken along line 17—17 in FIG. 16.

As shown in FIG. 16, and as stated previously, launching device 20 of the present invention is capable of projecting (or propelling) a large object such as a grappling hook 94. A launch tube 96 available in the art may be used to assist in projecting grappling hook 94. Grappling hook 94 may include a shaft 95 that may be connected to launch tube 96. In the present invention, specially designed spring clips 98 may be used to connect grappling hook 94 to launch tube 96 as shown in FIGS. 16 and 17. Spring clips 98 include first and second radiused arms 99 and 101 that define a diameter to correspond with the object to be projected (grappling hook 94 in this example) and launch tube 96 to which it is to be connected. Spring clips 98 provide an advantage over traditional methods for attaching grappling hook 94 to launch tube 96 in that it allows a number of different hook designs to be launched. The spring clips 98 may be reconfigured to accommodate different sized launch tubes 96 and different sized projectiles by bending radiused arms 99 and 101 to create a smaller or larger radius. Industrial strength zip-ties used in other available devices are more difficult to handle and require more time to assemble the object to the launch tube 96. Launch tube 96 is preferably constructed of a lightweight material with one end welded closed with a plug 102 (see FIG. 19). Grappling hook 94 may also include a bail 97 for attaching rope (not shown) to grappling hook 94. For example, one end of a length of rope may be attached to bail 97 and the other end may be attached to an object near the user. When grappling hook 94 is projected outwardly from launching device 20 and hooks itself on an object such as a tree, the user may use the rope to climb to that location.

Figure 19:
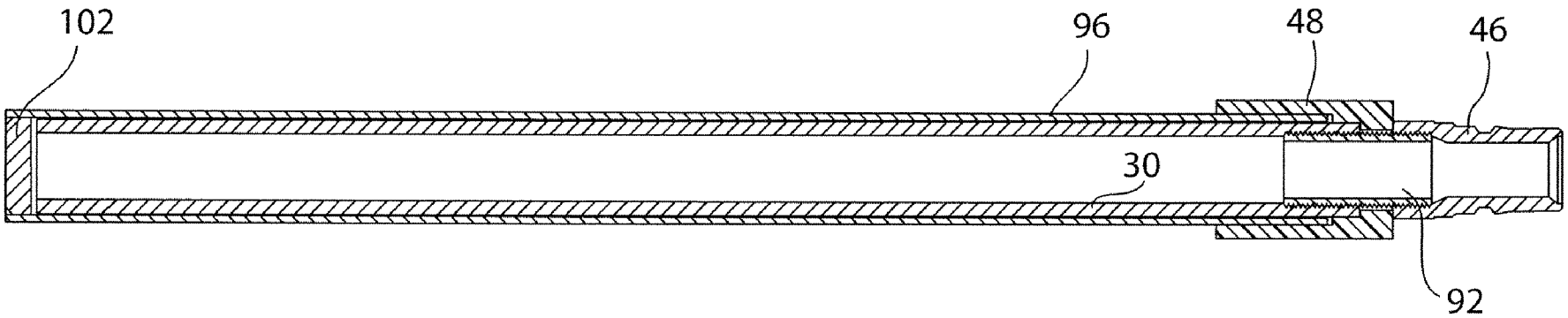
FIG. 19 is a sectional view of a barrel assembly of the present invention with a launch tube slidably received thereon.

In the embodiment shown in FIG. 18, barrel assembly 31 may include a plastic retainer sleeve 48 that fits radially over an outer surface of connector 92. Retainer sleeve 48 is captured between barrel 30 and barrel connector 46 as shown in FIGS. 18 and 19. A gap 100 between barrel 30 and retainer sleeve 48 is created as shown in FIG. 18. Launch tube 96 is then slidably received over the outer surface of barrel 30 and positioned within gap 100 to releasably hold it to barrel 30 (See FIG. 19). Retainer sleeve 48 provides enough resistance to hold launch tube 96 to barrel 30 and also offers resistance to launch tube 96 as it slides off barrel 30 when launching device 20 is fired. As described previously, to project or propel this type of large object outwardly from launching device 20, launching device 20 will need to be placed in a full evacuation mode by placing selector pin 90 in the lowered position within L-shaped slot 91. This will enable launching device 20 to produce the necessary amount of pressure and volume to project or propel grappling hook 94 outwardly from launching device 20.

Fire Extinguisher Embodiment

Figure 20:
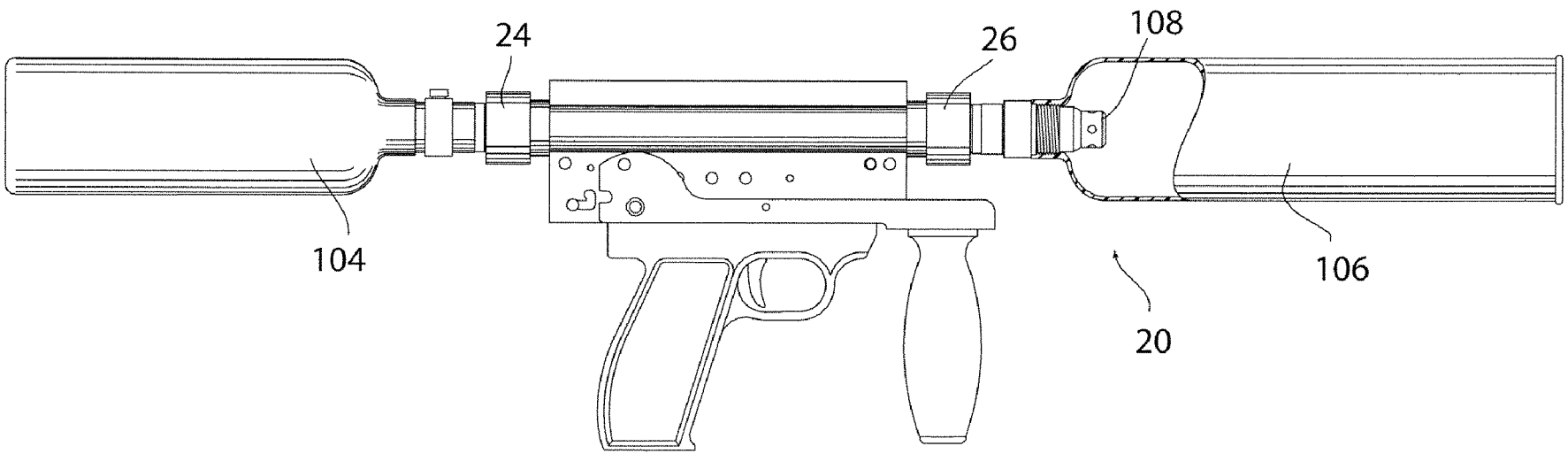
FIG. 20 is a side view of an embodiment of a launching device of the present invention.
Figure 21:
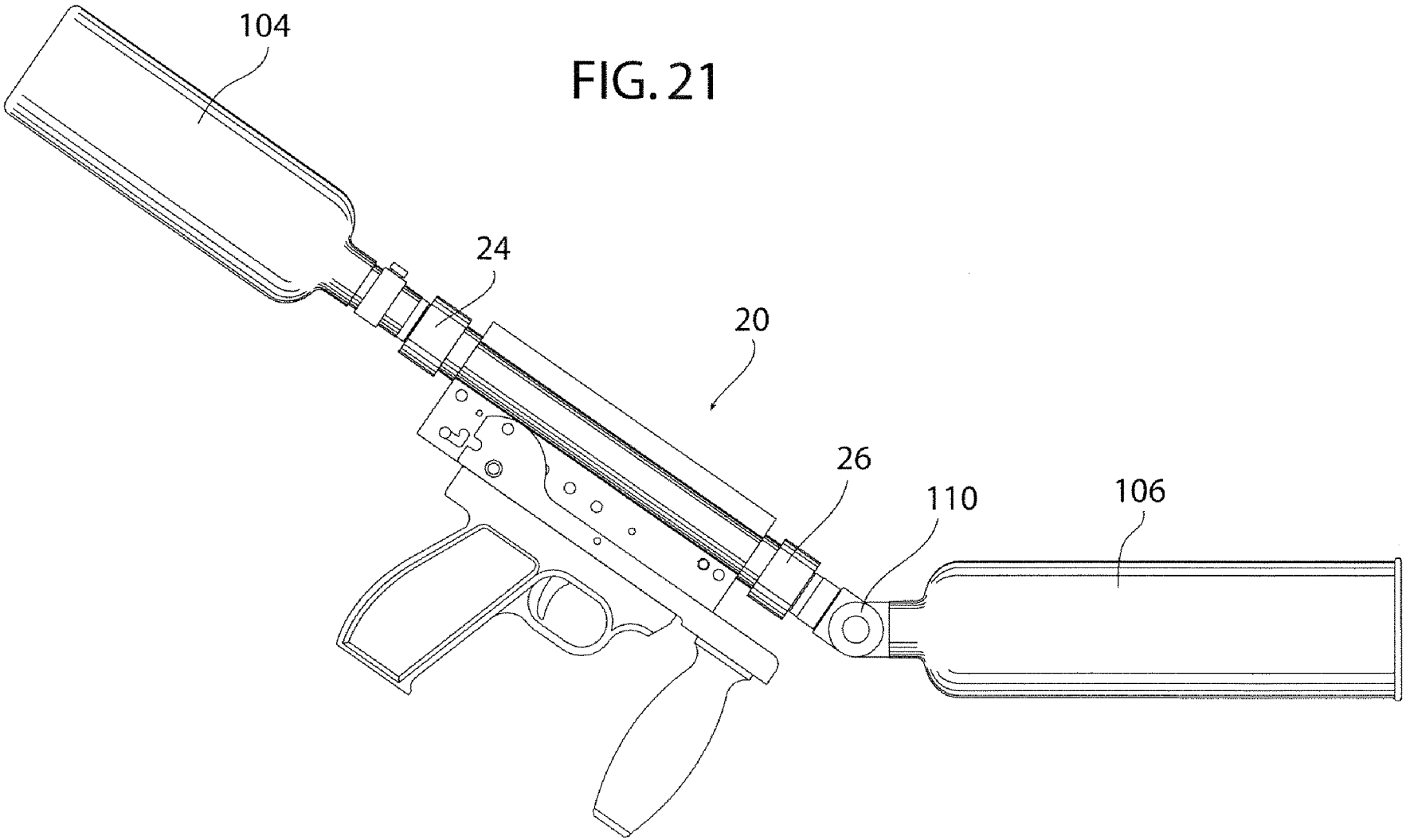
FIG. 21 is a side view of an embodiment of a launching device of the present invention.

Another unique and advantageous feature of the present invention is the ability to use launching device 20 to project liquid carbon dioxide outwardly from launching device 20 for use as a fire extinguisher. In this embodiment, a cylinder 104 containing liquid carbon dioxide ($CO_2$) may be used instead of cylinder 28 containing compressed air or nitrogen. The cylinder 104 may be coupled to launch unit 22. A quick connect coupling element, such as first coupling element 24, may be utilized in the same manner as in the attachment of cylinder 28 and as shown in FIG. 20. A special cone barrel 106 containing a diffuser 108, known in the art may also be coupled to launch unit 22. A quick connect coupling element, such as second coupling element 26, may be utilized in the same manner as in the connection of barrel 30. In use, the user may angle the launch unit 22 in a downward orientation when firing. This orientation will allow launch unit 22 to empty the entire contents of cylinder 104 in approximately ten to fifteen seconds. When the liquid carbon dioxide goes through the diffuser 108, it turns to a dry ice snow substance that is very effective at extinguishing fires. A pivot mechanism 110 may optionally be used to connect cone 106 to second coupling element 26 as shown in FIG. 21. This pivotal attachment allows the user to angle cone 106 in a variety of orientations relative to the user to meet the particular situation.

Benefits of the Present Invention

As stated previously, launching device 20 is capable of launching a variety of different objects due to the ability to quick connect any desired barrel size and shape suited for the particular object to be projected from launching device 20. The device is capable of instant engagement and disengagement of barrels and cylinders and is particularly advantageous for use in climbing, rescue or body retrieval activities. A user may carry a variety of different types of barrels that may be quickly installed on launching device 20 to reconfigure it for various uses. A user may also carry several cylinders 28 for quickly replacing an exhausted cylinder. If launching device 20 is constructed of materials such as polymers and non-ferrous metals or stainless steel, the present invention is also suitable for underwater applications such as for propelling a spear or harpoon. Other types of payloads that can be propelled from launching device 20 include flotation devices, survival gear, rappelling gear, and the like, which may be releasably mounted to barrel 30 in a similar manner as grappling hook 94. Another advantage of the present invention over other devices is the use of compressed gas instead of ignitable propellants. This benefit reduces the incidence of flash and excessive reports upon firing. The launching device 20 of the present invention also provides for the ability of the user to select between partial and full evacuation of the contents of the cylinder 28 (or 104) by simply moving the selector pin 90. In addition, the ability to reconfigure the launching device 20 to be used for fire fighting provides further superior features over other launching devices available in the art.

Thus, the present invention provides superior capabilities over other launching devices. An example of such superior capabilities includes the ability to launch a 0.4536 kg (1 pound) hook with 30.48 meters (100 feet) of rope approximately 24.384 meters (80 feet) vertically in the full evacuation mode. An example of the capabilities of the launching device in partial evacuation mode is its ability to fire an arrow at approximately 182.88 meters/second (600 feet/second) and yield approximately 12 shots per charged cylinder. In contrast, the average compound bow only shoots 60.96–76.2 meters/second (200–250 feet/second).

While the invention has been described in conjunction with specific embodiments, it is evident that many alternatives, modifications and variations will be apparent to those skilled in the art in light of the foregoing description. Accordingly, the present invention attempts to embrace all such alternatives, modifications and variations that fall within the spirit and scope of the appended claims.

The invention claimed is:

1. A launching device, comprising:

a launch unit including a first coupling element and second coupling element;

a barrel releasably connected to said first coupling element;

a cylinder releasably connected to said second coupling element; and a selector pin operably connected to said launch unit, wherein said selector pin is moveable between a first position and a second position, said first position permitting a partial evacuation of a content in said cylinder to be expelled from said cylinder, and said second position permitting the entire content of said cylinder to be expelled from said cylinder.

2. The launching device of claim 1, wherein said cylinder contains compressed gas.

3. The launching device of claim 1, wherein said cylinder contains liquid carbon dioxide.

4. The launching device of claim 2, wherein said compressed gas includes air.

5. The launching device of claim 2, wherein said compressed gas includes nitrogen.

6. The launching device of claim 1, further comprising a launch tube slidably received on said barrel, said launch tube configured to be connected to an object to be propelled outwardly from the launching device.

7. The launching device of claim 6, wherein said object includes a grappling hook.

8. The launching device of claim 6, wherein said object is adapted to be connected to said launch tube with a clip.

9. The launching device of claim 1, wherein said launch unit further includes a bolt assembly having a hollow bolt, a trigger and a locking sear, said bolt assembly being movable between a first and second position, and a valve assembly connected to said cylinder and to said second coupling element.

10. The launching device of claim 9, wherein upon actuation of said trigger said bolt assembly moves from said first position to said second position into engagement with said valve assembly and said locking sear engages said bolt assembly holding said bolt assembly in said second position.

11. The launching device of claim 10, wherein the contents of said cylinder are fully expelled from said cylinder upon actuation.

12. A launching device, comprising: a launch unit, a trigger, a bolt assembly having a hollow bolt, and a locking sear, said bolt assembly movable between a first position and a second position; a barrel connected to said launch unit; a valve assembly connected to said launch unit; a cylinder connected to said valve assembly; and wherein upon actuation of said trigger, said bolt assembly moves from said first position to said second position into engagement with said valve assembly and said locking sear engages said bolt assembly holding said bolt assembly in said second position.

13. The launching device of claim 12, wherein said cylinder includes liquid carbon dioxide.

14. The launching device of claim 12, wherein said cylinder includes compressed gas.

15. The launching device of claim 14, wherein said compressed gas includes nitrogen.

16. The launching device of claim 14, wherein said compressed gas includes air.

17. The launching device of claim 12, wherein said barrel is pivotally connected to said launch unit.

18. The launching device of claim 12, wherein the content of said cylinder is fully evacuated upon actuation of said trigger.

19. The launching device of claim 12, further including a launch tube slidably received on said barrel, said launch tube configured to connect to an object to be projected outwardly from the launching device.

20. The launching device of claim 12, wherein said object includes a grappling hook.

21. The launching device of claim 12, wherein said object is adapted to be connected to said launch tube with a clip.

22. The launching device of claim 13, wherein said barrel is cone shaped and includes a diffuser and said liquid carbon dioxide is expelled from the launching device to use the launching device as a fire extinguisher.

* * * * *